US006866435B2

(12) United States Patent
Kamamoto et al.

(10) Patent No.: US 6,866,435 B2
(45) Date of Patent: Mar. 15, 2005

(54) WRITING IMPLEMENTS

(75) Inventors: Hideki Kamamoto, Kanagawa-ken (JP); Michio Furusawa, Tokyo (JP)

(73) Assignees: Nagayanagi Co., Ltd., Tokyo (JP); Zebra Co., Ltd., Tokyo (JP)

( * ) Notice: Subject to any disclaimer, the term of this patent is extended or adjusted under 35 U.S.C. 154(b) by 17 days.

(21) Appl. No.: 10/284,420

(22) Filed: Oct. 31, 2002

(65) Prior Publication Data

US 2004/0086316 A1 May 6, 2004

(51) Int. Cl.[7] ..... A46B 5/02
(52) U.S. Cl. ..... 401/6; 16/430
(58) Field of Search ..... 401/6, 7, 195, 401/52; 16/430; D19/41, 47

(56) References Cited

U.S. PATENT DOCUMENTS

| | | | | |
|---|---|---|---|---|
| 768,985 A | | 8/1904 | Goldsmith | |
| 782,388 A | | 2/1905 | Goldsmith | |
| 4,167,347 A | * | 9/1979 | Hoyle | 401/88 |
| 4,601,598 A | * | 7/1986 | Schwartz et al. | 401/6 |
| 5,000,599 A | | 3/1991 | McCall et al. | |
| 6,019,533 A | | 2/2000 | Smith | |
| 6,273,626 B1 | | 8/2001 | Yazawa | |

FOREIGN PATENT DOCUMENTS

JP 63-60375 4/1988

OTHER PUBLICATIONS

English Language Abstract of JP 63–60375.

* cited by examiner

*Primary Examiner*—David J. Walczak
(74) *Attorney, Agent, or Firm*—Greenblum & Bernstein, P.L.C.

(57) ABSTRACT

A writing implement ensuring a non-slip grip on a barrel when it is grasped and a good fit between the grip and fingers, thus providing a comfortable grasping touch. In the writing implement having a grip made of elastic resin material fitted on an outer circumferential surface in a grasped area of a barrel, the grip is formed into a cylinder whose inner circumferential surface is fitted on the outer circumferential surface in the grasped area of the barrel, with hollows axially passing through a peripheral wall of the cylinder and with the plurality of hollows circumferentially arranged in parallel, and the grip is fitted on the barrel so as to form a vent passage for communication between the hollows and the outside at an end of the grip.

4 Claims, 4 Drawing Sheets

WRITING IMPLEMENTS

BACKGROUND OF THE INVENTION

1. Field of the Invention

The present invention relates to a writing implement having a grip fitted in a grasped area of a barrel.

2. Description of the Related Art

Conventionally, this type of writing implement commonly has a grip, which is formed into a cylinder made of elastic resin material, fitted in a grasped area of a barrel.

In the grip simply formed into a cylinder made of elastic resin material, elasticity in a grasp is left to elasticity characteristics of the elastic resin material itself.

Therefore, to improve the grasping touch, there has been disclosed an invention in Japanese Examined Utility Model Application No. 63-60375 (See FIG. 6A). In a writing implement according to the invention, a plurality of protrusions 110 are axially formed on an inner circumferential surface of a grip 100, so that gaps 111 are formed between the grip 100 and an outer circumferential surface of a barrel 120 when the grip is fitted on the barrel 120.

Additionally, in the writing implement according to the invention, a peripheral wall of the grip 100 is elastically deformed to sink into the gaps 111.

In the writing implement according to the invention, however, the grip 100 contacts the barrel 120 only at its tip face of the protrusions 110, by which the grip 100 is weakly fitted on the barrel 120, thus leading to concern over a slip on the barrel 120 when the grip is grasped.

Therefore, to increase the fitting force of the grip 100 on the barrel 120, it may be found to be useful to decrease the inside diameter of the bore formed by the tip faces of the plurality of protrusions 110. In this instance, however, adjacent peripheral wall sections between the protrusions 110, 110 are strained as shown in FIG. 6B, by which the gaps 111 collapse and the cross section is deformed to a polygonal shape (semi-triangle in the illustration). This disables the gaps 111 for providing a comfortable grasping touch and leads to a damage on the appearance.

Furthermore, in the writing implement according to the invention, the patterned indented inner circumferential surface of the grip 100 is elastically deformed when the grip is grasped, thus causing an unstable contact condition between the deformed inner circumferential surface and the outer circumferential surface of the barrel 120, by which the grip sometimes slips on the barrel 120.

Still further, in the writing implement according to the invention, the sealed gaps 111 of the grip 100 sometimes cause a too strong repulsion due to an air in the gaps 111, which sometimes results in an uncomfortable grasping touch.

SUMMARY OF THE INVENTION

The present invention has been provided in view of these conventional considerations. It is an object of the present invention to provide a writing implement ensuring-a non-slip grip on a barrel when it is grasped and a good fit between the grip and fingers, thereby providing a comfortable grasping touch.

According to one aspect of the present invention which achieves the above object, there is provided a writing implement having a grip made of elastic resin material, wherein the grip is formed into a cylinder whose inner circumferential surface is fitted on an outer circumferential surface in a grasped area of a barrel, with hollows axially passing through a peripheral wall of the cylinder and with the plurality of hollows circumferentially arranged in parallel, and wherein the grip is fitted on the barrel so as to form a vent passage for communication between the hollows and the outside at an end of the grip.

Note that the elastic resin material includes synthetic rubber, silicone resin, elastomer resin, and other resin materials having elasticity of providing a good fit for fingers when it is grasped.

According to the above aspect of the invention, the outer circumferential surface of the grip is easy to deform elastically due to the plurality of hollows existing in the peripheral wall of the grip when the grip is grasped. The hollows absorb the elastic deformation of the outer circumferential surface of the grip and therefore the deformation has almost no effect on the inner circumferential surface of the grip. Therefore, there is no deformation of the inner circumferential surface and no slip occurs between the inner circumferential surface and the outer circumferential surface of the barrel. In addition, an air in the grip is let off through the vent passage when the grip is grasped and therefore fingers sink deep into the outer circumferential surface of the grip.

Furthermore, to get a favorable appearance, the periphery of the vent passage is covered with a ring-shaped member with ensuring proper airflow between the hollows of the grip and the outside.

To achieve more comfortable grasping touch, the number of hollows in the grip should be a multiple of 3.

Preferably, the elastic resin material is silicone resin as the material providing the comfortable grasping touch.

To further improve the grasping touch, preferably the outer circumferential wall section between the outer circumferential surface of the cylinder and the hollows ranges from approx. 0.5 to 1.5 mm in wall thickness, and further preferably it is approx. 1.1 mm.

DESCRIPTION OF THE PREFERRED EMBODIMENT(S)

The preferred embodiments of the present invention will now be described in detail hereinafter with reference to the accompanying drawings.

Figure 1:
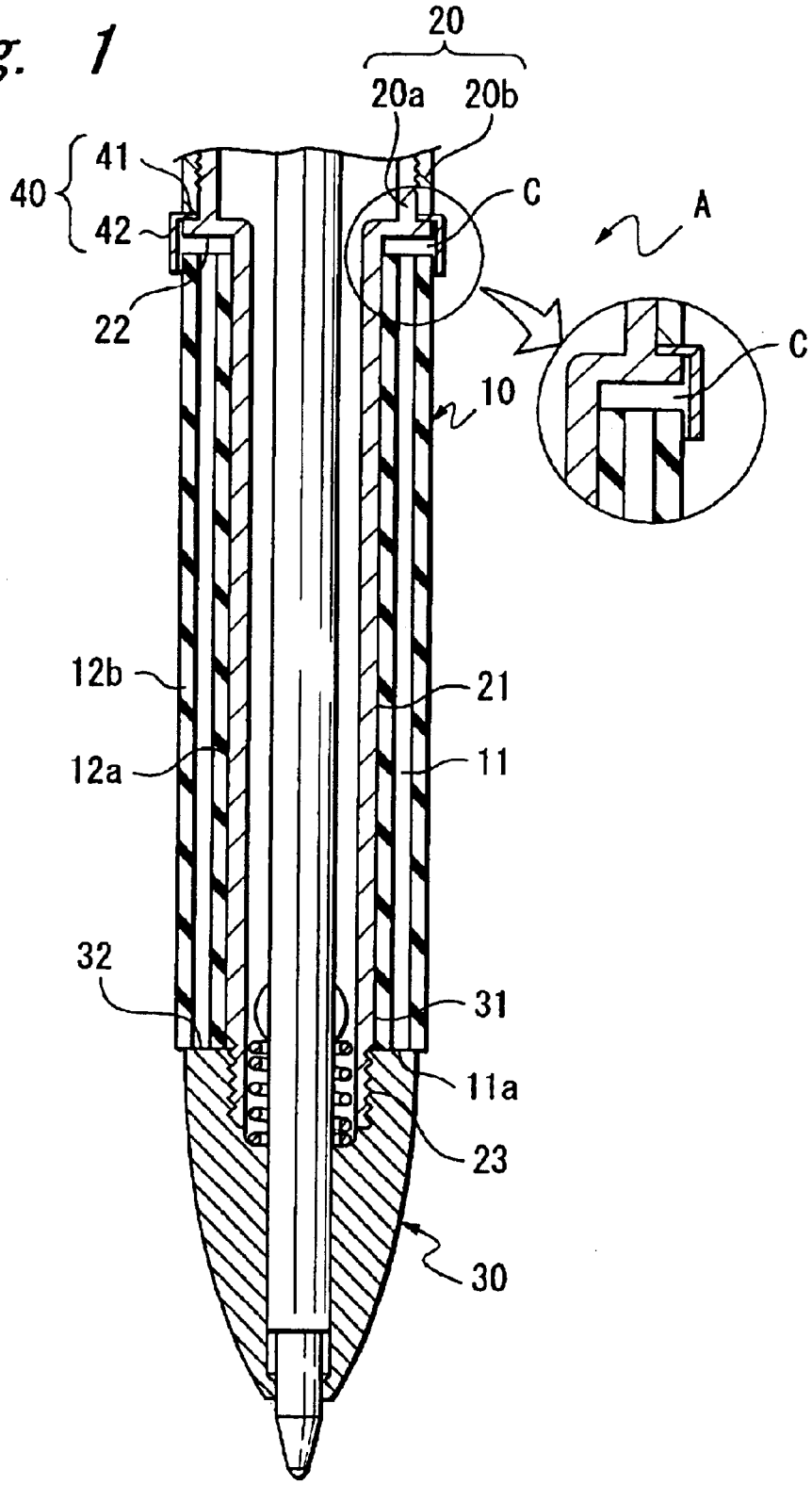
FIG. 1 is a relevant part longitudinal section showing an example of a writing implement according to the present invention.

Referring to FIG. 1, there is shown an example of a writing implement according to the present invention.

The writing implement A is a ball-point pen having a grip 10 fitted in a grasped area in the forward section of a barrel 20.

The barrel 20 comprises a forward barrel 20*a* and a backward barrel 20*b* screwed together, forming a contracted diameter section 21 for fitting the grip on the forward barrel 20*a* and forming a screw section 23 for screwing a socket 30 together at the front end of the contracted diameter section 21.

Figure 2:
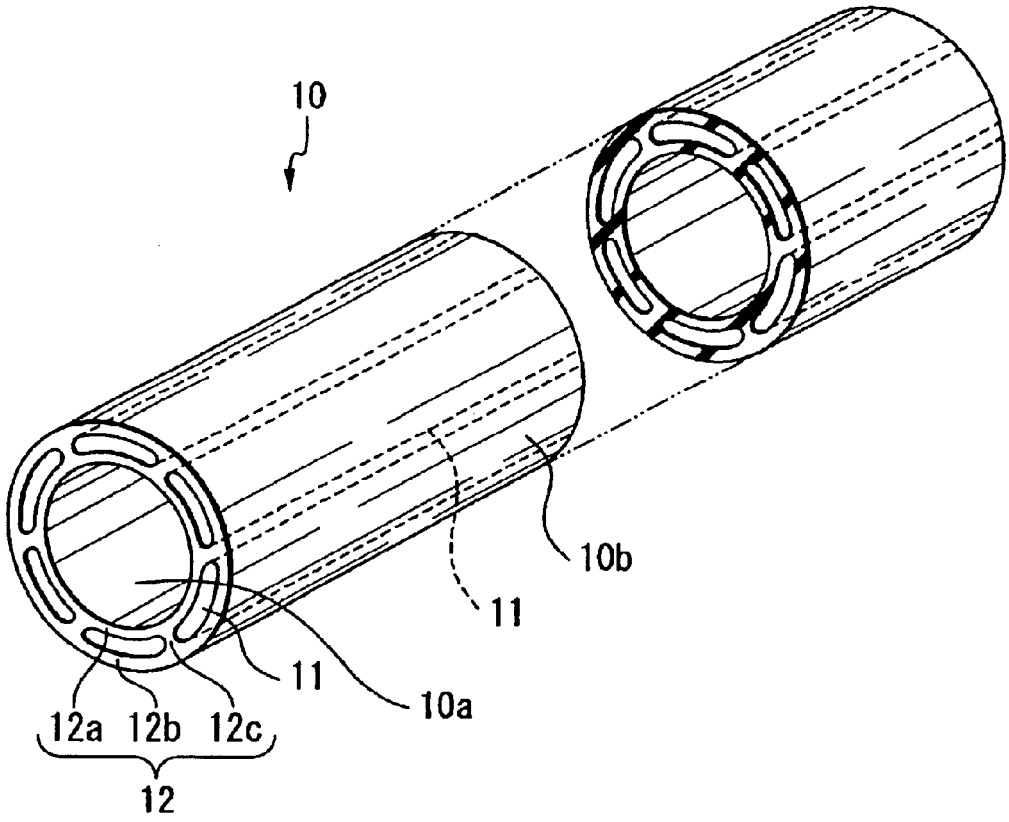
FIG. 2 is a perspective view showing a grip of the writing implement according to the present invention.
Figure 3:
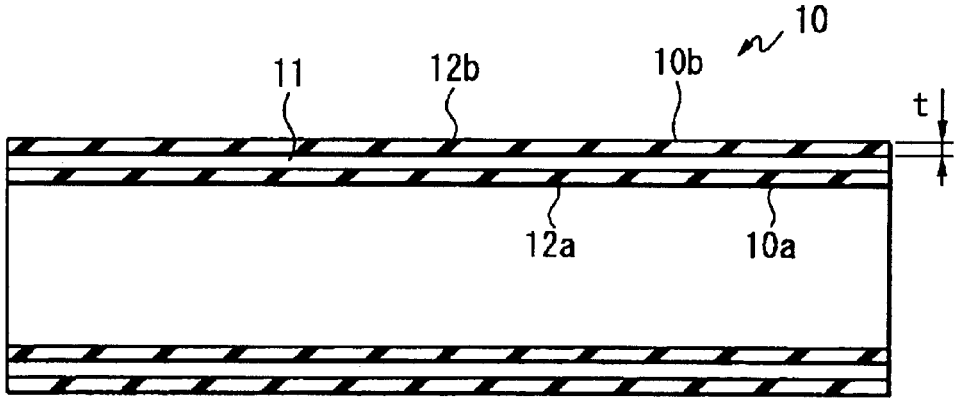
FIG. 3 is a longitudinal section of the grip.

The grip 10 is a cylinder formed by extruding silicone resin into a tube and cutting it to a predetermined length, with a plurality of hollows 11 arranged in parallel in the peripheral wall 12 between an inner circumferential surface 10*a* of the cylinder and an outer circumferential surface 10*b* thereof as shown in FIGS. 2 and 3.

The peripheral wall 12 comprises an inner circumferential wall 12*a* inside the hollows 11 and an outer circumferential wall 12*b* outside the hollows 11, and the inner circumferential wall 12*a* and the outer circumferential wall 12*b* are coupled integrally by a plurality of supports 12*c*.

The inner circumferential wall 12*a* forms a cylinder with its inner circumferential surface 10*a* fitted on the outer circumferential surface of the contracted diameter section 21 in the forward barrel 20*a*. Its inside diameter is set smaller than the outside diameter of the contracted diameter section 21 so that it has an appropriate fitting force on the contracted diameter section 21.

The hollow 11 axially pass through the peripheral wall 12, having aperture ends 11*a*, 11*a* at both ends of the peripheral wall 12.

Figure 4:
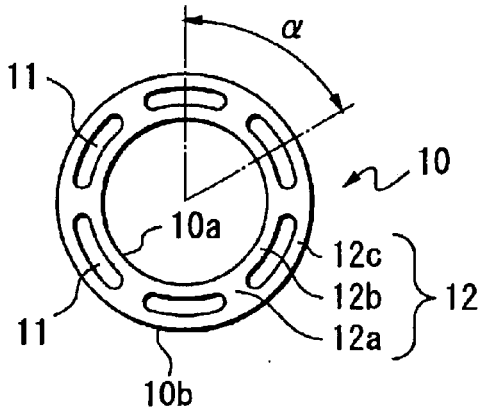
FIG. 4 is an end view of the grip.

The plurality of hollows 11 are arrange at intervals of angel α (See FIG. 4) in a circumferential direction and the number of hollows is set at a multiple of 3 so that the grip is grasped with three fingers, namely, the forefinger p1, the middle finger p2, and the thumb p3. In the illustration, the angle α is set at 60 deg and six hollows are applied to the number of hollows 11.

The outer circumferential wall section 12*b* is formed so as to make it easier to deform elastically when the grip is grasped by setting a wall thickness t of the outer circumferential wall section 12*b* between its outer circumferential surface 10*b* and the hollows 11 at a relatively small value ranging from approx. 0.5 to 1.5 mm.

The socket 30 is screwed in the screw section 23 at the front end of the forward barrel 20*a* by contacting a rear end face 32 of the socket 30 against a front end face of the grip 10 after the grip 10 is fitted on the contracted diameter section 21 of the forward barrel 20*a*.

The axial length of the grip 10 is set a little shorter than spacing between a recess shoulder 22 formed by the contracted diameter section 21 and the rear end face 32 of the screwed socket 30, thereby securing a vent passage c for letting off an air in the hollows 11 of the grip 10 at a portion between the recess shoulder 22 at the rear end of the contracted diameter section 21 and a rear end face of the grip 10.

In addition, a ring-shaped member 40 is held tight between the forward barrel 20*a* and the backward barrel 20*b* forming the barrel 20.

The ring-shaped member 40 comprises a tight-held section 41 between the forward barrel 20*a* and the backward barrel 20*b* and a collar 42 arranged around the vent passage c integrally.

The collar 42 is formed to make some gap between its inner circumferential surface and the outer circumferential surface of the grip 10, thereby ensuring proper airflow between the hollows 11 of the grip 10 and the outside without sealing off the vent passage c.

The gap between the inner circumferential surface of the collar 42 and the outer circumferential surface of the grip 10 can be the narrowest gap almost invisible in appearance only if an air in the hollows 11 of the grip 10 can be let off to the outside when the grip 10 is grasped.

While the ring-shaped member 40 can be omitted, it covers the vent passage c between the recess shoulder 22 and the rear end face of the grip 10 and therefore preferably it is arranged as described in this embodiment to improve the appearance.

Figure 5:
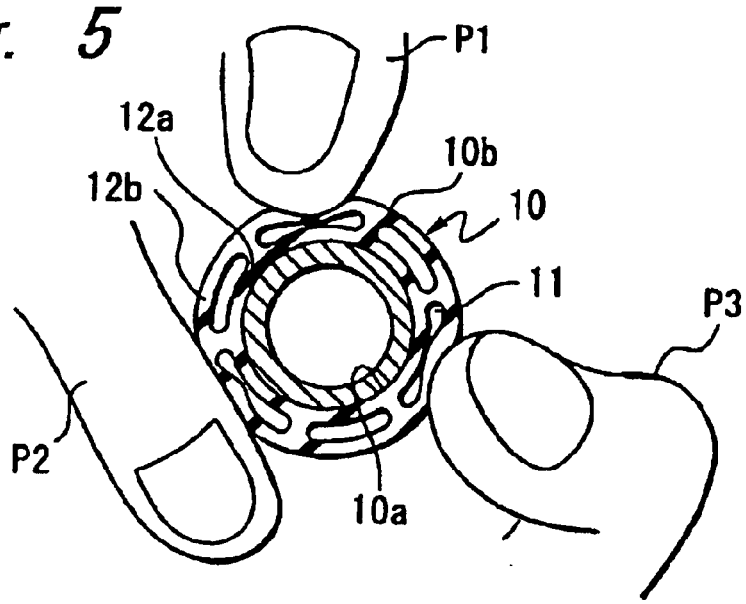
FIG. 5 is a cross section showing a condition in which the writing implement according to the present invention is grasped, where a structure inside a barrel is omitted.
Figure 6A:
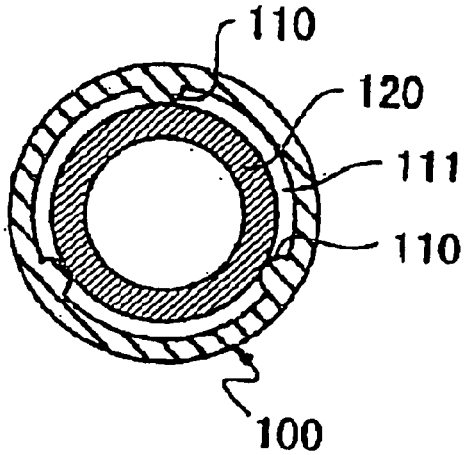
FIG. 6A Prior Art
FIGS. 6A and 6B are transverse cross sections showing an example of a conventional writing implement, FIG. 6A illustrating a condition in which a grip is attached to a barrel and FIG. 6B illustrating a condition in which a fitting force of the grip is increased.
Figure 6B:
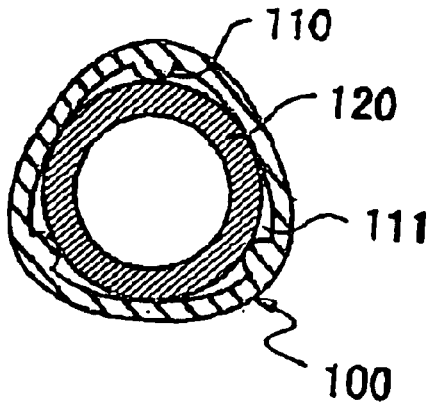
FIG. 6B Prior Art

Thus, according to the writing implement A having the above structure, the outer circumferential wall section 12*b* is elastically deformed as if the hollows 11 were crushed from the outside when the grip 10 is grasped with three fingers, namely, the forefinger p1, the middle finger p2, and the thumb p3 as shown in FIG. 5.

At the same time, an air in the hollows 11 is discharged to the outside from the vent passage c at the rear end of the grip 10.

Therefore, each of the fingers p1, p2, and p3 sinks deep into the outer circumferential surface 10*b* of the grip 10, thereby getting a comfortable grasping touch ensuring a good fit between the fingers and the grip 10.

Additionally, the plurality of hollows 11 exist between the inner circumferential wall 12*a* and the outer circumferential wall 12*b* in the above grasped condition, by which the elastic deformation of the outer circumferential wall 12*b* has almost no effect on the inner circumferential wall 12*a*.

Therefore, the grip 10 provides a stable contact condition between the inner circumferential surface 10*a* of the grip and the outer circumferential surface of the barrel 20, thereby ensuring no slip on the barrel 20 in the axial nor circumferential direction.

The number of hollows 11 in the grip 10 can be a plural number other than a multiple of 3. Also in this instance, the stable contact condition between the inner circumferential surface 10*a* of the grip 10 and the outer circumferential surface of the barrel 20 prevents the slip on the barrel 20 of the grip 10 in the axial or circumferential direction and provides a comfortable grasping touch achieved by the plurality of hollows 11 communicating with the outside by way of the vent passage c. To get a more comfortable grasping touch, however, preferably the number of hollows 11 is a multiple of 3 such as 3, 6, 9, 12, or the like as set forth in the embodiment.

Since the present invention is configured as set forth hereinabove, it will thus have the effects as described below.

According to the first embodiment of the present invention, the inner circumferential surface of the grip is in contact with whole area of the outer circumferential surface of the barrel, by which the grip can keep a strong fitting force on the barrel. In addition, even if the inside diameter of the grip is set smaller than the outside diameter of the barrel in order to further increase the fitting force of the grip on the barrel, the outer circumferential surface is deformed little and therefore it does not detract from the appearance of the grip.

Furthermore, since the inner circumferential surface of the grip is little deformed when the grip is grasped, this invention is free from an unstable contact between the grip and the barrel due to a deformation of the inner circumferential surface of the grip as in the grip of the conventional writing implement having protrusions on the inner circumferential surface.

Furthermore, an air in the hollows is let off through the vent passage when the grip is grasped, by which the outer circumferential surface of the grip is easily deformed elastically and the fingers sink deep into the outer circumferential surface of the grip.

Therefore, the invention is free from a slip of the grip on the barrel in the axial or circumferential direction when the grip is grasped and provides a good fit between the grip and fingers, thereby providing a comfortable grasping touch.

Furthermore, according to the second embodiment of the invention, the periphery of the vent passage is covered with a ring-shaped member, by which the gap of the vent passage does not detract from the appearance of the grip.

Still further, if the number of hollows in the grip is set at a multiple of 3 as described in the third embodiment of the invention, the hollows are to be arranged correspondingly to respective three fingers, the forefinger, the middle finger and the thumb for grasping the writing implement. Therefore, the areas corresponding to the respective fingers on the grip can be easily deformed elastically, thereby improving the grasping touch.

Furthermore, according to the fourth embodiment of the invention, the silicone resin provides elasticity, a soft touch, and a good fit for fingers, thereby further improving the grasping touch.

Still further, according to the fifth embodiment of the invention, the outer circumferential surface of the grip is easy to deform elastically, thereby further improving the grasping touch.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A writing implement fitted with a grip made of elastic resin material, wherein said grip comprises a cylinder whose inner circumferential surface is fitted on an outer circumferential surface in a grasped area of a barrel, with a plurality of hollows axially passing through a peripheral wall of the cylinder and with the plurality of hollows circumferentially arranged in parallel, and wherein the grip is fitted on the barrel so as to form a vent passage for communication between said hollows and the outside at an end of the grip, wherein a periphery of the vent passage is covered with a ring-shaped member that ensures proper airflow between the hollows of the grip and the outside.

2. The implement according to claim 1, wherein the number of hollows of the grip is a multiple of 3.

3. The implement according to claim 1, wherein the elastic resin material is silicone resin.

4. The implement according to claim 1, wherein an outer circumferential wall section between an outer circumferential surface of the cylinder and the hollows ranges from approximately 0.5 mm to 1.5 mm in wall thickness.

* * * * *